US006685023B2

(12) United States Patent
Bleggi et al.

(10) Patent No.: US 6,685,023 B2
(45) Date of Patent: Feb. 3, 2004

(54) CASE FOR FLEXIBLE ELONGATED OBJECTS

(76) Inventors: Melissa Ann Bleggi, R.R. #2, Box 294, Wellsboro, PA (US) 16901; Kathleen D. Plumley, 92 Pearl St., Wellsboro, PA (US) 16901

( * ) Notice: Subject to any disclaimer, the term of this patent is extended or adjusted under 35 U.S.C. 154(b) by 111 days.

(21) Appl. No.: 09/970,303

(22) Filed: Oct. 3, 2001

(65) Prior Publication Data

US 2003/0062285 A1 Apr. 3, 2003

(51) Int. Cl.[7] ..... B65D 73/00

(52) U.S. Cl. ..... 206/493; 206/6.1; 206/566; 211/85.2; D3/903

(58) Field of Search ..... 206/6.1, 566, 493, 206/478, 480, 482, 483, 303, 523, 315.11, 561, 348; 211/85.2, 59.1; D3/903

(56) References Cited

U.S. PATENT DOCUMENTS 1,059,561 A * 4/1913 Parks ..... 312/118
3,195,717 A * 7/1965 Senter ..... 206/303
3,540,576 A * 11/1970 Pierce ..... 206/303
4,413,736 A * 11/1983 Nibling ..... 206/566
4,733,806 A * 3/1988 Sloop ..... 206/316.2
4,848,585 A 7/1989 Snyder
4,978,001 A * 12/1990 Nelson ..... 206/748
5,269,090 A * 12/1993 Richards et al. ..... 43/57.2
5,358,100 A 10/1994 Wolff
D364,505 S 11/1995 King
5,931,319 A * 8/1999 Murphy ..... 211/85.2
6,012,571 A 1/2000 LaPierre
6,059,098 A 5/2000 Ovadia et al.
6,161,686 A * 12/2000 Simon et al. ..... 206/6.1

* cited by examiner

*Primary Examiner*—Jila M. Mohandesi
(74) *Attorney, Agent, or Firm*—Thomas R. Shaffer, Esq.

(57) ABSTRACT

The present invention discloses a case for carrying and storing flexible elongated objects. The case includes a base member, which has an upper surface with a plurality of upwardly extending pegs. A lid is releasably attached to the base member with said pegs being in contact with said lid when said lid is in closed position. With this arrangement the elongated objects are restrained from movement by the pegs and tangling of the elongated objects is reduced.

9 Claims, 4 Drawing Sheets

CASE FOR FLEXIBLE ELONGATED OBJECTS

BACKGROUND OF THE INVENTION

I. Field of the Invention

The present invention relates to a case for carrying and storing flexible elongated objects. More specifically, it relates to a case used to carry flexible elongated objects (such as, for example, necklaces and bracelets) in a manner which prevents or reduces the objects from becoming damaged or tangled.

II. Description of the Prior Art

There are many known cosmetic and jewelry cases which purport to facilitate the carrying and storing of jewelry and the like. Wolff, U.S. Pat. No. 5,358,100 discloses a container for holding and storing items such as cosmetics and jewelry in an organized fashion. This device essentially provides a plurality of compartments which are specially configured to hold specific items. Such devise does not, however, provide a solution to carrying a plurality of necklaces or the like in a manner which prevents damage from excessive bending or which prevents tangling with other necklaces or the like. Similarly, King, U.S. Pat. No. Des. 364,505 shows a jewelry organizer which simply provides a plurality of compartments.

Ovadia et al., U.S. Pat. No. 6,059,098 discloses a jewelry case for holding a plurality of rings which includes spaced apart layers of ring posts 52 that are offset and interleaved with each other when the jewelry case is closed. Ovadia et al. does not address the problems associated with the carrying or storing of necklaces or other flexible elongated objects.

LaPierre, U.S. Pat. No. 6,012,571 discloses a jewelry case to carry chain jewelry such as necklaces and bracelets. The device purports to prevent damage and tangling of such chain jewelry by tensioning the same within the case between two spring-biased points. LaPierre teaches that it is important that the proper level of tension be imparted to each article of jewelry to avoid damage thereto. Accordingly, the jewelry can be tensioned between a variety of points which are located at different distances, thus, different sized chain jewelry can be accommodated. A plurality of peg rows are aligned with plural spring biased hook carriers. The hook carriers are capable of slidable movement toward the peg row. While the device of LaPierre does provide a method of reducing tangling, it is overly complex and time consuming to properly use. Often the user does not have the time or inclination to meticulously place the chain jewelry items, one item at a time, into the case. Also, there are many extremely fragile and delicate necklaces and bracelets which are made from soft materials which can withstand little or no tensioning force without the possibility of being damaged.

Snyder, U.S. Pat. No. 4,848,585, discloses a jewelry storage case having a plurality of compartments for hanging and organizing jewelry items. The case includes trays 12a–12c which are hinged together. The jewelry case of Snyder is adapted to be supported vertically as shown in FIG. 1. Apertures 68 are provided for holding earrings. As best shown in FIGS. 1 and 6, a plurality of hooks 70 each having an L-shaped portion defined by extending bar 72 and an end retain bar 74. A deformable upper retaining bar 78 prevents accidental escape of the necklace 76 if the jewelry case 10 is turned upside down. The Snyder device requires each necklace and the like to individually be placed upon a particular hook and retained in place which is an overly time consuming task. Further, while the retaining bar 78 may prevent escape of a necklace 76 the Snyder device clearly would not prevent tangling with other long necklaces hanging adjacent to necklace 78 if the case is turned upside down.

There remains a need for a case for carrying and storing flexible elongated objects which allows for easy insertion and removal of such objects without risk of damage or tangling.

SUMMARY OF THE INVENTION

The present invention solves these problems by providing a case for carrying and storing flexible elongated objects. In its simplest form the case includes: a base member, said base member having an upper surface with a plurality of upwardly extending pegs; a lid adapted to cover said upper surface of said base member; and, preferably, a securing means for releasable attaching said lid to said base member with said pegs being in contact with said lid when said lid is attached to said base member in a closed position whereby said elongated objects are restrained from movement by said pegs and tangling of said elongated objects is reduced.

Preferably said base member further comprises a base insert provided on said base member upper surface, said base insert having said plurality of upwardly extending pegs therein. Preferably said base insert is formed of a resilient material with limited compression properties.

Said pegs may be evenly spaced over substantially the entire area of said upper surface of said base member but preferably said pegs are evenly spaced over only a portion of the entire area of said upper surface of said base member. Preferably, said pegs are evenly spaced over approximately 60–90% of the entire area of said upper surface of said base member with an area located along one edge of said upper surface having no pegs.

Preferably, said pegs are positioned in evenly spaced rows and columns on said upper surface of said base member with said rows and columns spaced approximately ¾ of an inch apart.

In a preferred embodiment of the invention said pegs are generally cylindrical in shape. This shape for the pegs allows for a large upper surface area of the pegs to contact and compress the foam to more securely hold the elongated objects in place. In an alternative embodiment of the invention, said pegs are generally frusto-conical in shape with lower portions of said pegs having a larger diameter than upper portions thereof to allow for elongated objects to be more easily placed onto and removed from and around said pegs. In this alternative embodiment, said pegs have a generally rounded head portion thereon to allow for elongated objects to be more easily placed onto and removed from and around said pegs. In both embodiments, said pegs are preferably approximately ½ of an inch in height.

While it is preferred that the pegs of the present invention have the geometry of a typical conventional peg with a generally circular cross sectional configuration, the term peg as used herein is not so limited. The term "peg" as used herein is defined broadly and includes structure which extends upwardly from the upper surface of the base member and may have any size, shape or geometry. The outside perimeter of the base of a peg is preferably located entirely within the upper surface of the base member so that elongated objects will rest upon the upper surface of the base member with the pegs extending upwardly through or adjacent the elongated objects. Pegs may, for example, have a cross sectional configuration which is circular, square, oval, rectangular or even any of a number of more complex shapes such as "L" shaped or "T" shaped, to name just a few examples. There may only be but a few large pegs (of any desired shape) which cover a large portion of the available surface area of the upper surface of the base member. With this arrangement, the large pegs might leave only a few valleys or passageways between the pegs which extend down to the upper surface upon which the elongated objects will rest. Preferably, however, there are many smaller pegs as shown is in the drawings.

In a preferred embodiment of the invention, said lid further comprises a container top and a lid insert, said lid insert being a foam material such as a sheet of adhesive backed polyurethane foam having a thickness of approximately ⅛ of an inch thick.

Preferably, said pegs are in contact with and compress and are partially embedded in said foam material when said lid is attached to said base member in a closed position. Further it is preferred that said lid be pivotally attached to said base member and be adapted for motion between a closed position and an open position.

Preferably, a separate securing means is provided for releasably attaching said lid to said base member. Any of a variety of known securing devices may be utilized such function such as, for example: a latch which attaches to a latch receiving block; straps; a hook and an eye member; an elastic member such as a rubber band or bungee cord; tape; Velcro strips or connectors; a magnetic connection; snaps; buttons; a zipper; or an adhesive product which may be reused for more than one adhesion, to name but just a few. A separate securing means is not required, however, and the lid may be designed to have flanges or the like which are releasably held by friction over the perimeter of the base member. The lid may be otherwise releasably secured to base member without the use of a separate securing means.

Another embodiment of the present invention provides a case for carrying and storing flexible elongated objects as well as other objects and includes: a base member, said base member having an upper surface with a plurality of upwardly extending pegs and a lower surface having at least one compartment divider to create a plurality of compartments; a lid adapted to cover said upper surface of said base member; securing means for releasable attaching said lid to said base member with said pegs being in contact with said lid when said lid is attached to said base member whereby said elongated objects are restrained from movement by said pegs and tangling of said elongated objects is reduced; a second lid to cover said lower surface of said base member; and a second securing means for releasable attaching said second lid to said base member with said at least one compartment divider being in contact with said second lid when said second lid is attached to said base member whereby other objects within said plurality of compartments are fully securely contained therein at least in part by said at least one compartment divider and by said second lid.

Preferably, said second lid further comprises a container top and a second lid insert, said second lid insert also being a foam material such as a sheet of adhesive backed polyurethane foam having a thickness of approximately ⅛ of an inch.

The present invention is particularly useful in carrying and storing flexible elongated objects such as necklaces, bracelets and other chain jewelry and other objects such as cosmetics and other jewelry. Alternatively, the case can be effectively used to carry flexible elongated objects such as fishing leaders and the like together with other objects such as tackles, lures and the like.

Preferably, the case has a plurality of adjustable compartment dividers provided to allow for the creation of a plurality of compartments of various desired sizes to hold objects of a desired size.

Preferably said lid is pivotally attached to one end of said base container and said second lid is pivotally attached to an opposite end of said base contained. Said securing means and said second securing means are each preferably in the form of latches which attach to a latch receiving block.

DETAILED DESCRIPTION OF THE PREFERRED EMBODIMENTS

Figure 1:
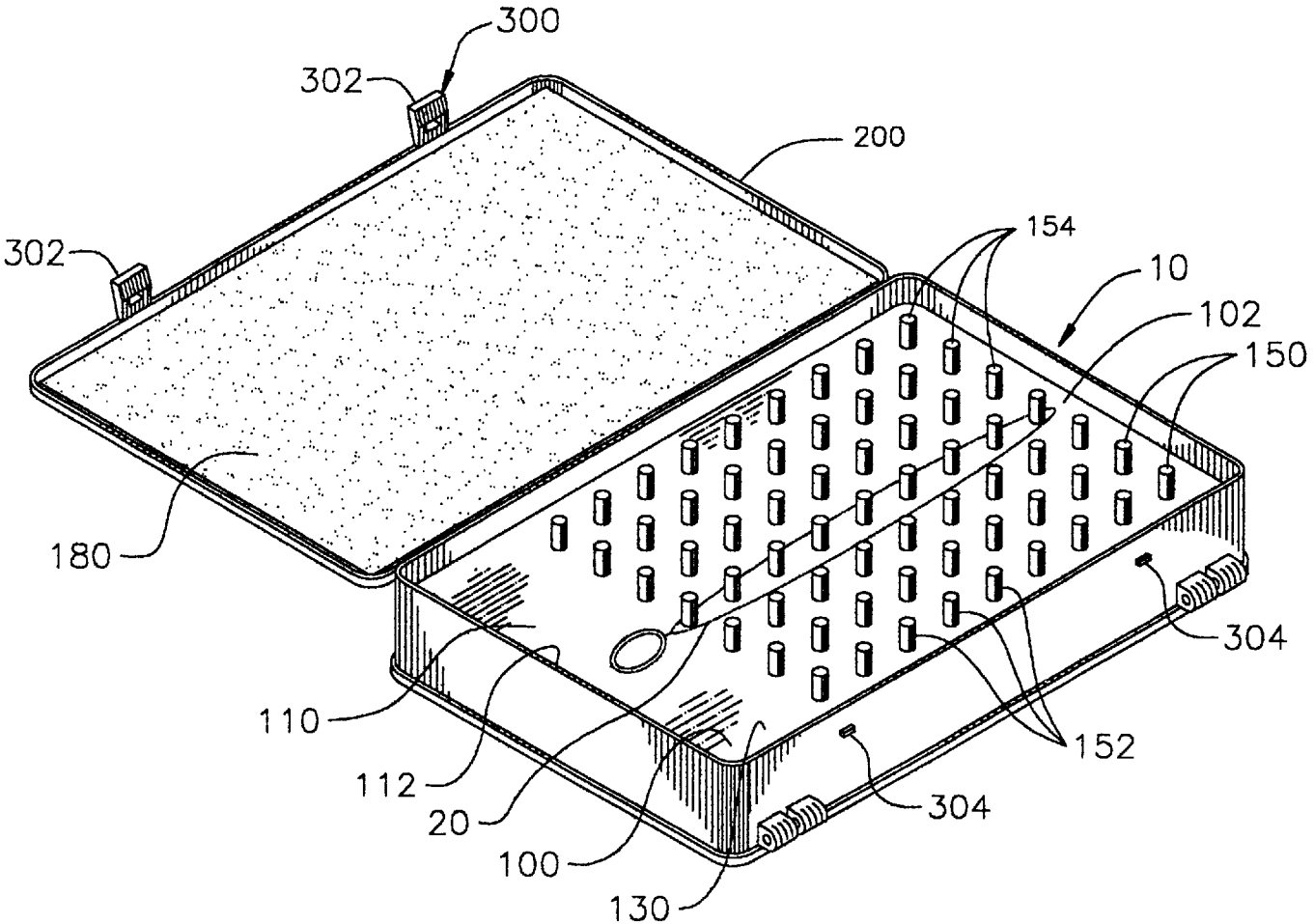
FIG. 1 is an isometric view of the top of the base, base insert and lid of the case of the present invention.
Figure 2:
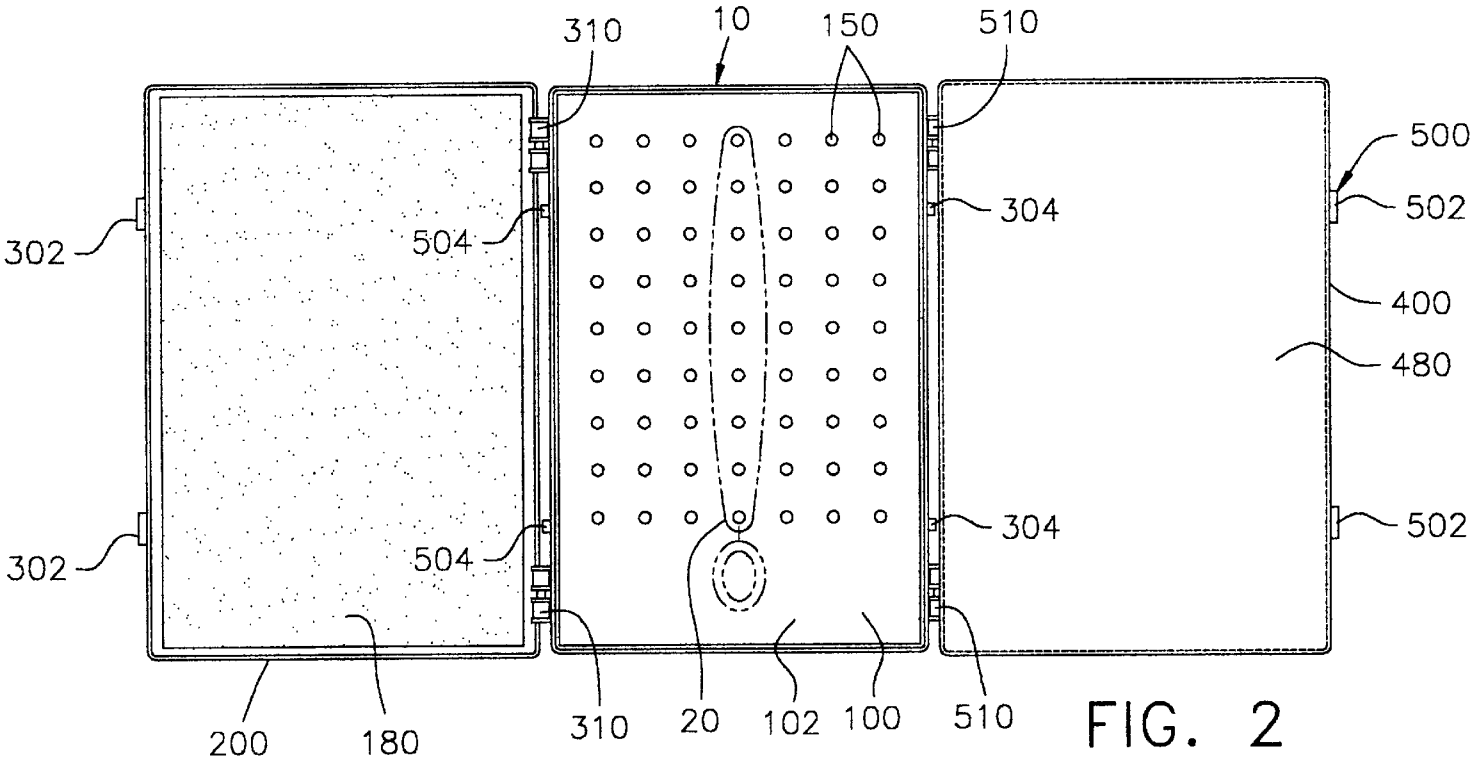
FIG. 2 is a top view of the base, lid, and second lid of the present invention.

Referring to FIGS. 1–5, the presently preferred embodiment of the present invention is shown. A case 10 for carrying and storing flexible elongated objects, such as necklace 20 is shown. The case includes a base member 100 which has upper surface 102 with a plurality of upwardly extending pegs 150. While the pegs 150 can be formed directly into the upper surface, it is preferred to provide a separate base insert 130 formed of a resilient material with limited compression properties and having said plurality of upwardly extending pegs 150 therein.

A lid 200 is provided which is adapted to cover said upper surface 102 of said base member 100. Securing means 300 in the form of latches 302 and latch block 304 are provided for releasable attaching said lid 200 to said base member 100 with said pegs 150 being in contact with said lid 200 when said lid 200 is attached to said base member 100 in a closed position. With this arrangement elongated objects 20 are restrained from movement by said pegs 150 and tangling of said elongated objects 20 is reduced.

Said pegs 150 may be evenly spaced over substantially the entire area of said upper surface of said base member. Preferably, however, said pegs 150 are evenly spaced over only a portion of the entire area of said upper surface 102 of said base member 100, such as approximately 60–90% of the entire area of said upper surface 102 of said base member 100 with an area 110 located along one edge 112 of said upper surface 100 having no pegs. The open area 110 allows room for large items of jewelry such as crosses or pendants which are attached to necklace chains and the like. As shown said pegs 150 are positioned in evenly spaced rows (pegs 154 being in one row) and columns (pegs 152 being in one column) on said upper surface 102 of said base member 100. Preferably, said rows and columns on said upper surface 102 of said base member 100 are spaced approximately ¾ of an inch apart.

Figure 5:
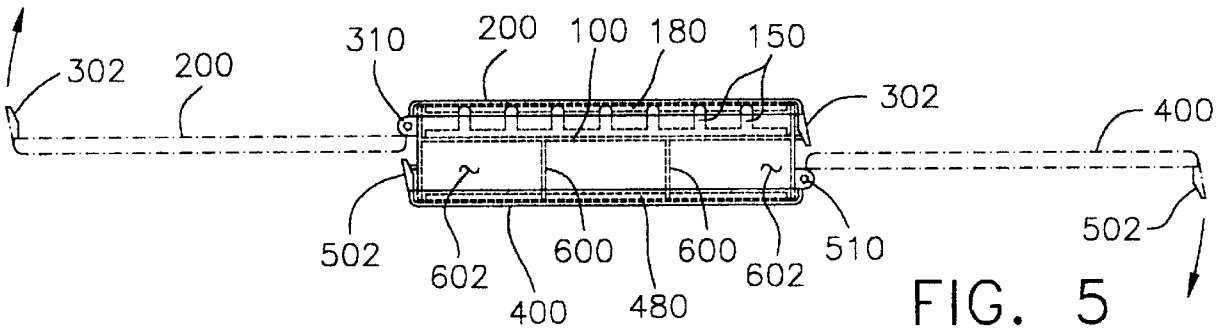
FIG. 5 is and end elevational view of the case of the present invention with the lid and second lid shown in a closed position and in chain line in an open position.
Figure 6:
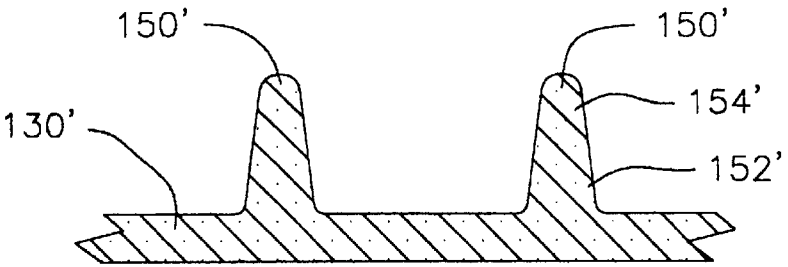
FIG. 6 is a cross sectional view of a portion of a modified base insert showing frusto-conical shaped pegs.

As shown in FIGS. 1–5 said pegs 150 are preferably generally cylindrical in shape but may in any other convenient shape such as the generally frusto-conical shape of pegs 150' as shown in FIG. 6 with lower portions 152' of said pegs 150' having a larger diameter than upper portions 154' thereof to allow for elongated objects 20 to be more easily placed onto and removed from and around said pegs 150'.

Figure 4:
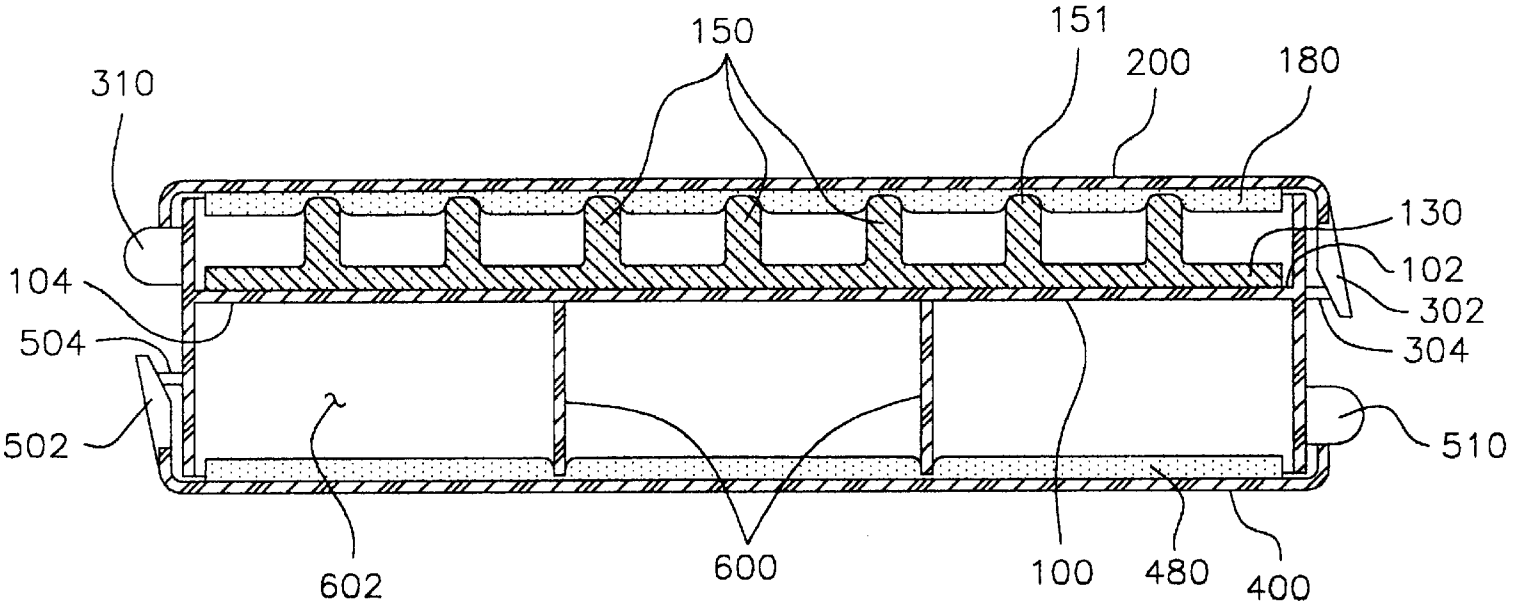
FIG. 4 is a cross sectional view of the case of the present invention showing pegs in contact with the foam lid insert and compartment dividers in contact with the second lid insert.

As best shown in FIG. 4, pegs 150 preferably have a generally rounded head portion 151 thereon to allow for elongated objects 20 to be more easily placed onto and removed from and around said pegs 150. Although the dimensions of the pegs 150 will depend upon the type and size of elongated objects 20 which will be placed thereon, for most chain jewelry objects said pegs 150 are preferably approximately ½ of an inch in height.

The lid 200 preferably includes a lid insert 180 formed from a foam material such as a sheet of adhesive backed polyurethane foam. For chain jewelry items the said sheet 180 is preferably approximately ⅛ of an inch thick. As best shown in FIG. 4, the pegs 150 come in contact with and compress and are partially embedded in said foam material of the lid insert 180 when said lid 200 is attached to said base member 100 in a closed position. As is shown, the lid 200 is pivotally attached by hinges 310 to said base member 100 and is adapted for motion between a closed position and an open position (as shown in FIG. 5).

While not necessary, the case of the present invention preferably also includes a plurality of compartments for carrying other objects in addition to storing flexible elongated objects. Accordingly base member 100 not only includes an upper surface 102 with a plurality of upwardly extending pegs 150, base member 100 also preferably included a lower surface 104 having at least one compartment divider 600 to create a plurality of compartments 602. Lid 200 is adapted to cover said upper surface 102 of said base member and is held closed by securing means 300 for releasable attaching said lid 200 to said base member 100 with said pegs 150 being in contact with said lid 200 when said lid 200 is closed. A second lid 400 is provide to cover said lower surface 104 of said base member 100 and a second securing means 500 is provided for releasable attaching said second lid 400 to said base member 100 with said at least one compartment divider 600 being in contact with said second lid 400 when said second lid 400 is attached to said base member whereby other objects within said plurality of compartments are fully securely contained therein at least in part by said at least one compartment divider 600 and by said second lid 400.

Preferably said second lid 400 further comprises a container second lid insert 480 formed of a foam material such as is a sheet of adhesive backed polyurethane foam preferably approximately ⅛ of an inch thick. With this arrangement, the case 10 can conveniently carry and hold both elongated objects secured by pegs 150 such as necklaces, bracelets or other chain jewelry as well as other objects in the compartments 602 such as cosmetics and jewelry such as rings and earrings. While the present invention is intended to be used to carry chain jewelry it is not limited to carrying and holding only such items and may be used to carry any imaginably type or kind of flexible elongated objects. For but one example the elongated objects may be fishing leader lines and the like and said other objects may be, for example lures, tackles and other fishing gear.

Figure 3:
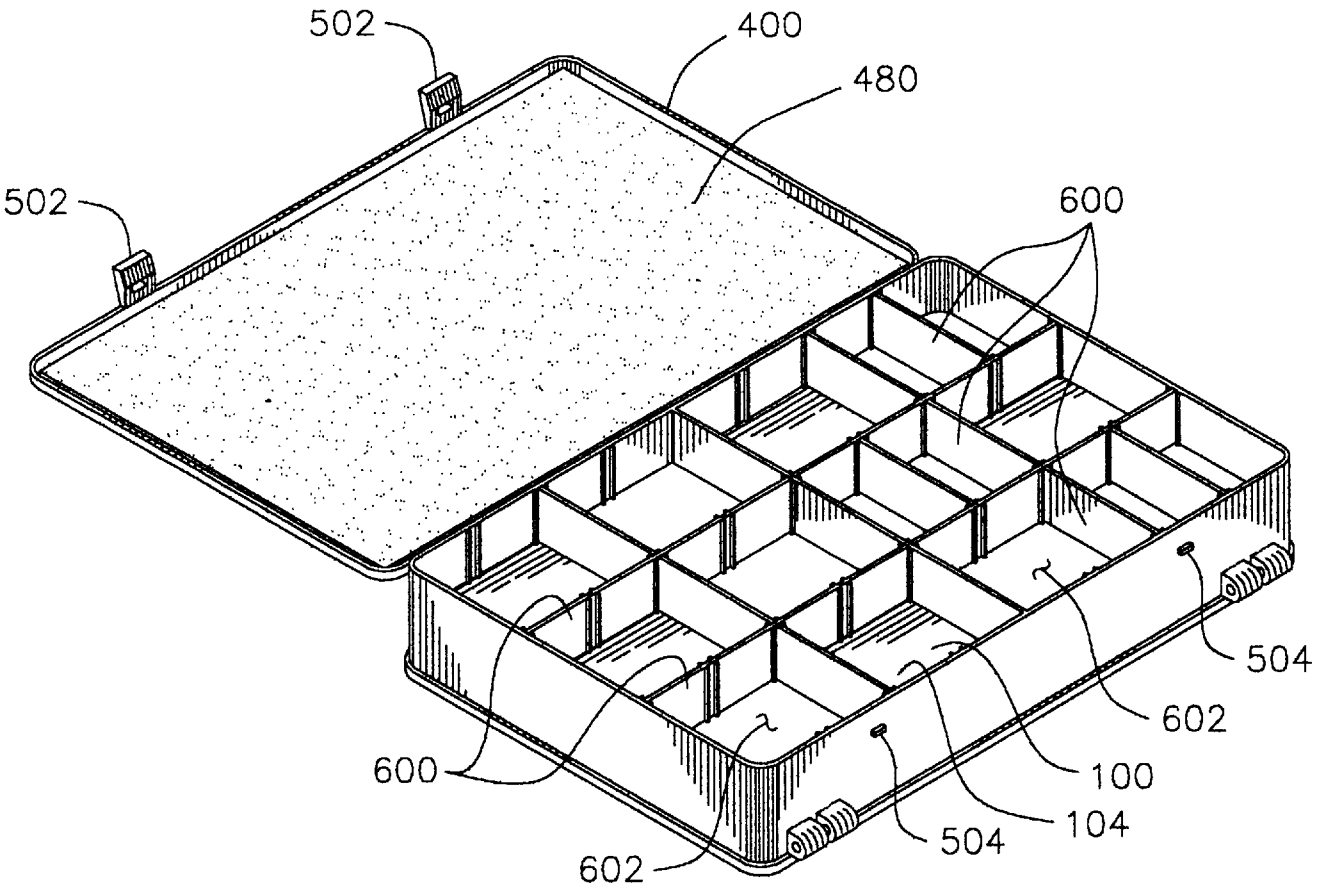
FIG. 3 is an isometric view of the bottom of the base and the second lid of the case of the present invention.

As can be best seen in FIG. 3, the case 10 provides plurality of adjustable compartment dividers 600 are provided to allow for the creation of a plurality of compartments 602 of various desired sizes to hold objects of a desired size.

The lid 200 is pivotally attached to one end of said base member by hinges 310 and said second lid 400 is pivotally attached to an opposite end of said base member by hinges 510. Securing means 300 and said second securing means 500 are, respectively, each in the form of latches 302, 504 which attach to a latch receiving blocks 304, 504.

In use, latches 302 are pulled out and lid 200 is moved to an open position. This exposes the pegs 150. A plurality of necklaces, bracelets, chain jewelry or any flexible objects may be dropped or thrown in any haphazard manner onto the pegs 150. Each elongated object will wrap around various pegs from various rows and columns of pegs 150. A great advantage of the present invention is that no care whatsoever is needed when placing the elongated objects on the pegs and packing of the elongated objects can be accomplished almost instantaneously. For the sake of clarity of the drawings, the necklace 20 is shown neatly placed over a column of pegs 150 but in actual practice the necklace 20 would more likely be in a figure "8" pattern or some more complex pattern and wrapped around various random pegs.

Once the elongated objects are literally thrown onto the pegs the cover 200 is closed and the foam insert 180 presses against the pegs and holds the elongated object firmly in place and precludes and possible tangling from the case being turned upside down or being otherwise moved or shaken during travel.

Once the elongated objects are packed, the case 10 is turned over and latches 502 are pulled out and second lid 400 is opened. Dividers 600 are quickly arranged to provide the desired size, number and location of compartments 602 and other objects such as cosmetics or the like are packed into the compartments 602. The second lid 400 is closed and secured and second lid insert 480 presses against the compartment dividers 600 to seal such other objects in their respective compartments 602.

While we have shown and described the presently preferred embodiment of our invention, the invention is not limited thereto and may be otherwise variously practiced within the scope of the following claims:

We claim:

1. A case for carrying and storing flexible elongated objects comprising:

a) a base member, said base member having an upper surface with a plurality of upwardly extending pegs and a lower surface having at least one compartment divider to create a plurality of compartments;

b) a lid adapted to cover said upper surface of said base member;

c) securing means for releasable attaching said lid to said base member with said pegs being in contact with said lid when said lid is attached to said base member whereby said elongated objects are restrained from movement by said pegs and tangling of said elongated objects is reduced;

d. a second lid to cover said lower surface of said base member; and e. a second securing means for releasable attaching said second lid to said base member with said at least one compartment divider being in contact with said second lid when said second lid is attached to said base member whereby other objects within said plurality of compartments are fully securely contained therein at least in part by said at least one compartment divider and by said second lid.

2. A case according to claim 1 wherein said second lid further comprises a container top and a second lid insert, said second lid insert being a foam material.

3. A case according to claim 2 wherein said foam material is a sheet of adhesive backed polyurethane foam.

4. A case according to claim 3 wherein said sheet is approximately ⅛ of an inch thick.

5. A case according to claim 1 wherein said elongated objects are necklaces and said other objects are cosmetics and jewelry.

6. A case according to claim 1 wherein said elongated objects are fishing leader lines and the like and said other objects are lures, tackles and other fishing gear.

7. A case according to claim 1 wherein a plurality of adjustable compartment dividers are provided to allow for the creation of a plurality of compartments of various desired sizes to hold objects of a desired size.

8. A case according to claim 1 wherein said lid is pivotally attached to one end of said base container and said second lid is pivotally attached to an opposite end of said base contained.

9. A case according to claim 1 wherein said securing means and said second securing means are each in the form of latches which attach to a latch receiving block.

* * * * *

UNITED STATES PATENT AND TRADEMARK OFFICE

CERTIFICATE OF CORRECTION

PATENT NO. : 6,685,023 B2
DATED : February 3, 2004
INVENTOR(S) : Melissa A. Bleggi and Kathleen D. Plumley It is certified that error appears in the above-identified patent and that said Letters Patent is hereby corrected as shown below:

Title page,
Item [57], ABSTRACT,
Line 5, delete “said” after “member with”
Line 5, insert -- the -- after “member with”
Line 6, delete “said” after “when”
Line 6, insert -- a -- after “in”

Column 2,
Line 17, change “releasable” to -- releasably --

Column 3,
Line 9, change “shown is” to -- is shown --
Line 23, insert -- for -- after “utilized”
Line 29, delete “but” after “name”
Line 34, insert -- the -- before “base”
Line 48, change “releasable” to -- releasably --
Line 53, insert -- and -- after “fully”

Column 4,
Line 7, change “contained” to -- container --
Line 22, change “and” to -- an --
Line 43, , change “releasable” to -- releasably --
Line 66, insert -- be -- after “may”

Column 5,
Line 31, change “included” to -- includes --
Lines 35 and 39, change “releasable” to -- releasably --
Line 37, change “provide” to -- provided --
Line 44, insert -- and -- after “fully”
Line 49, delete “is” after “as”
Line 58, change “imaginably” to -- imaginable --
Line 63, insert -- a -- after “provides”
Lines 64 and 65, delete “are provided” after “600”

UNITED STATES PATENT AND TRADEMARK OFFICE

CERTIFICATE OF CORRECTION

PATENT NO. : 6,685,023 B2
DATED : February 3, 2004
INVENTOR(S) : Melissa A. Bleggi and Kathleen D. Plumley It is certified that error appears in the above-identified patent and that said Letters Patent is hereby corrected as shown below:

Column 6,
Line 5, change “504” to -- 502 --
Line 23, change “and” to -- any --
Line 36, change “embodiment” to -- embodiments --
Line 48, change “releasable” to -- releasably --
Line 54, change “d.” to -- d) --
Line 56, change “e.” to -- e) --
Line 61, insert -- and -- after “fully”

Column 8,
Line 6, change “contained” to -- container --

Signed and Sealed this

Fifteenth Day of June, 2004

JON W. DUDAS
*Acting Director of the United States Patent and Trademark Office*